United States Patent [19]

Shaine

[11] Patent Number: 4,702,026

[45] Date of Patent: Oct. 27, 1987

[54] METHOD OF MAKING PAGES FOR PHOTO ALBUMS AND PAGES THEREBY FORMED

[75] Inventor: William L. Shaine, Westhampton, Mass.

[73] Assignee: SPM Manufacturing Corporation, Holyoke, Mass.

[21] Appl. No.: 838,324

[22] Filed: Mar. 10, 1986

[51] Int. Cl.[4] ..... G09F 1/10

[52] U.S. Cl. ..... 40/159; 40/158 R; 156/243

[58] Field of Search ..... 40/159, 158, 16 R, 405, 40/537; 156/243

[56] References Cited

U.S. PATENT DOCUMENTS

| | | | |
|---|---|---|---|
| 4,244,762 | 1/1981 | Holson | 40/159 |
| 4,431,470 | 2/1984 | Schubert | 40/159 |
| 4,452,666 | 6/1984 | Dorman | 40/159 |
| 4,471,545 | 9/1984 | Dorman | 40/159 |

*Primary Examiner*—Gene Mancene

*Assistant Examiner*—Wenceslao J. Contreras

*Attorney, Agent, or Firm*—Salter & Michaelson

[57] ABSTRACT

A method of making pages for photo albums and the like comprises the steps of passing a first elongated continuous sheet of a flexible transparent plastic material through a work station, extruding a plurality of spaced lines of a hot-melt pressure-sensitive adhesive onto the first sheet at the work station, overlaying a second elongated continuous sheet of flexible transparent plastic material on the first sheet, pressing the two sheets together so that they are secured together with the adhesive to define a composite sheet, and transversely cutting the composite sheet at predetermined intervals to form a plurality of pages. The flexible transparent sheets preferably comprise biaxis-oriented polypropylene sheets having thicknesses of less than approximately 2 mils. The pages made by the method are durable and effective, and they can be made at substantially higher rates and lower cost than the previously-available pages.

13 Claims, 4 Drawing Figures

METHOD OF MAKING PAGES FOR PHOTO ALBUMS AND PAGES THEREBY FORMED

BACKGROUND AND SUMMARY OF THE INVENTION

The instant inventon relates to the mounting of photographs and the like and more particularly to a method of making pages for photo albums and to a page thereby formed.

While a variety of different types of pages have been heretofore available for mounting photographs and the like in albums, one particular type of page comprising a pair of flexible transparent plastic sheets which are heat sealed together along a plurality of seam lines has been found to be highly popular and effective. The heretofore available pages of this type have generally comprised a pair of sheets made of PVC plastic having thickness of approximately 3 mils. The sheets thereof have generally been heat sealed together along three or four spaced substantially parallel seam lines which define the top and bottom edges of their respective pages and which also define a plurality of transversely extending compartments therein for receiving and positioning photographs and the like between the sheets thereof. Pages of this type have frequently also included strips of paper or the like in the compartments thereof for providing backgrounds for photographs received in the compartments. Unfortunately, however, because it has generally been necessary to utilize relatively expensive plastic materials, such as PVC having thicknesses of at least 3 mils., for the sheets of pages of this type, the heretofore-available pages of this type have generally been relatively expensive. In many cases it has been found that it is necessary to treat the sheets of pages of this type with corona treatments in order to enable them to be effectively bonded by heat sealing. Accordingly, the sheets which have been utilized in the heretofore-available pages for photo albums of the above-described type have generally been relatively expensive; and because they have had thicknesses of at least 3 mils. and they have required corona treatments, they have often lacked clarity. Further, while automated processes have been heretofore available for manufacturing continuous strips of connected pages, these processes have been limited to relatively slow production rates by the heat sealing steps thereof. Still further, while attempts have been made to manufacture pages for photo albums of this general type by sonically welding sheets of transparent plastic materials together instead of by heat sealing the sheets, it has been found that pages made by this method have had similar disadvantages. In addition, it has been found that seams which are made in thin plastic sheets by sonic welding processes are often weak and lack durability and that when plastic sheets are sonically welded together, hazardous gases are often produced which are environmentally unacceptable.

The instant invention provides an effective page for a photo album and an effective method of making pages which have substantial advantages over the heretofore available pages and methods. Specifically, the instant invention provides a method which can be effectively utilized for making pages for photo albums from thinner, less expensive sheet materials having higher degrees of clarity, and the method can also be effectively applied in high-speed processes for rapidly making large quantities of pages. In this regard, the method of the instant invention comprises the steps of passing a continuously moving first elongated continuous sheet of flexible transparent plastic material through a work station, and continuously extruding at least two spaced narrow streams of a liquified hot-melt pressure-sensitive adhesive onto the first sheet to form at least two narrow, spaced, longitudinally extending lines of adhesive thereon. The method further comprises the steps of continuously overlaying a continuously moving second elongated continuous sheet of flexible transparent plastic material is substantially aligned relation on the first sheet so that the second sheet contacts the lines of adhesive, and pressing the first and second sheets together to secure them together along the lines of adhesive so that they form a continuous composite sheet, and thereafter transversely cutting the composite sheet at predetermined intervals to form pages for a photo album or the like. The first and second sheets preferably comprise biaxis-oriented polypropylene sheets having thicknesses of less than approximately 2 mils., and the pressing step is preferably carried out by passing the two sheets between a pair of rollers to press them together. The adhesive which is utilized in the method preferably comprises a hot-melt pressure-sensitive adhesive having a melting point of between 120° F. and 350° F. and having a viscosity of less than 2500 cp. at 350° F., and the adhesive is preferably extruded at a temperature of approximately 325° F. The sheets are preferably moved at a speed of greater than 100 ft./min. so that the adhesive is rapidly cooled by the air, and the adhesive is preferably cooled to a temperature of less than 120° F. within less than five seconds from the time that it first contacts the first sheet and preferably before the second sheet is overlayed on the first sheet.

It has been found that the method of the instant invention can be effectively carried out utilizing biaxis-oriented polypropylene sheets having thicknesses of less than approximately 2 mils. In this connection, heretofore it has generally been considered to be impossible to effectively secure sheets of this type together by heat sealing, but it has now been found that instead they can be effectively secured together with a pressure-sensitive adhesive of the type hereinabove specified. In this regard, since the cost of biaxis-oriented polypropylene sheet material having a thickness of 1.8 mils. is approximately 40% of the cost of PVC sheet material having a thickness of approximately 3 mils., substantial material savings are realized when pages are made in accordance with the method of the instant invention. Further, since biaxis-oriented polypropylene sheets having thicknesses of less than 2 mils. have substantially improved clarity, the pages made by the method of the instant invention also have improved clarity. Still further, since the sheets of pages made by the method of the instant invention are secured together with a pressure-sensitive adhesive, if one of the seams on a page becomes damaged so that the sheets of the page can be separated, the seam can easily be repaired by pressing the two sheets together in the area of the damaged seam.

Accordingly, it is a primary object of the instant invention to provide an improved method for manufacturing pages for photo albums and the like.

A further object of the instant invention is to provide a method for manufacturing pages for photo albums at a reduced cost.

An even further object of the instant invention is to provide a method of manufacturing pages for photo albums and the like utilizing sheets of biaxis-oriented polypropylene.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
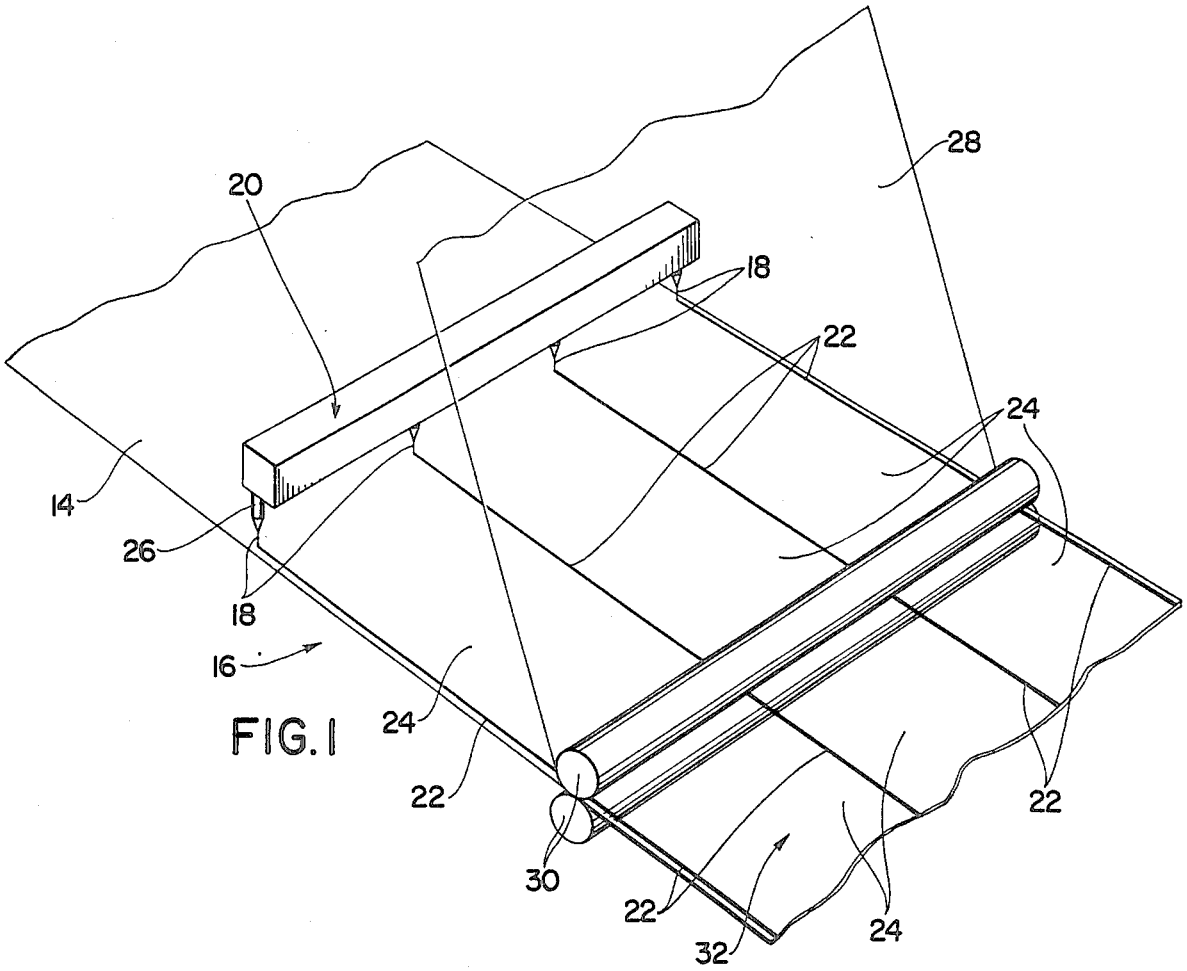
FIG. 1 is a perspective view illustrating the method of the instant invention.
Figure 2:
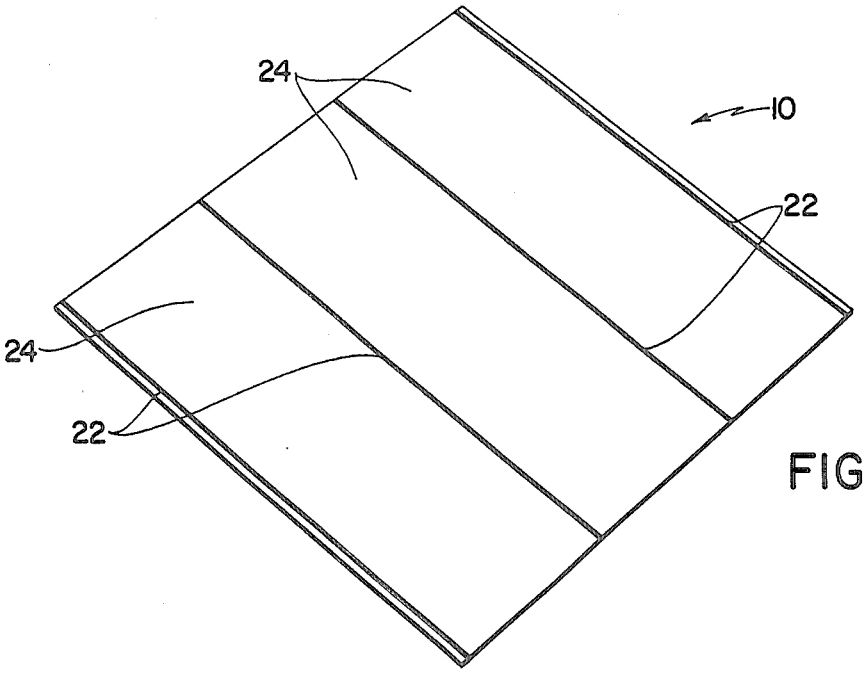
FIG. 2 is a perspective view of a page made by the method.
Figure 3:
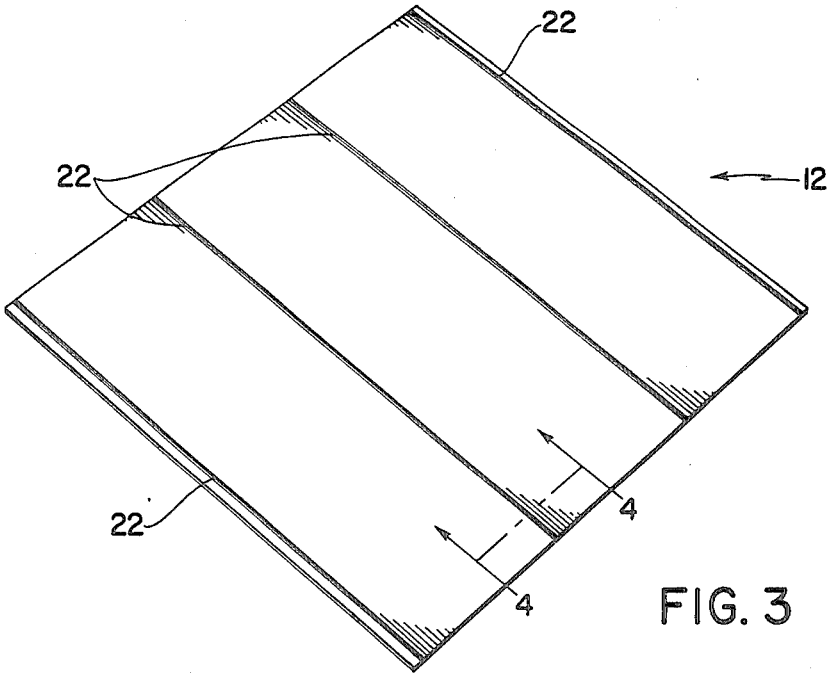
FIG. 3 is a perspective view of another type of page made by the method.
Figure 4:
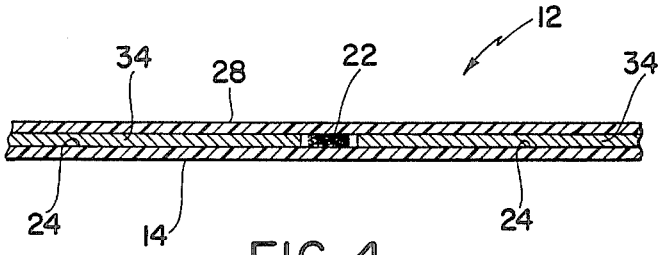
FIG. 4 is a sectional view taken along line 4—4 in FIG. 3.

Referring now to the drawings, the method of the instant invention is illustrated in FIG. 1, and it is operative for manufacturing pages of the type generally indicated at 10 in FIG. 2 as well as pages of the type generally indicated at 12 in FIGS. 3 and 4.

In the first step of the method of the instant invention, an elongated continuous sheet 14 of a flexible transparent plastic material is continuously passed through a work station generally indicated at 16. The sheet 14 preferably comprises a sheet of biaxis-oriented polypropylene having a thickness of less than approximately 2 mils., and it is preferably continuously passed to the work station 16 at a speed which is in excess of 100 ft./min. As the sheet 14 is passed through the work station 16, a plurality of streams 18 of a liquified hot-melt pressure-sensitive adhesive are continuously extruded onto the sheet 14 with an extruder assembly 20 in order to form a plurality of narrow, spaced, longitudinally extending lines 22 of adhesive thereon. In this connection, the outermost lines 22 are preferably disposed adjacent the opposite edges of the sheet 14 to provide seams along the upper and lower edges of the pages 10 formed by the method, whereas the remaining lines 22 are preferably equally spaced inwardly from the longitudinal edges of the sheet 14 so that open areas 24 are defined therebetween, the open areas 24 preferably being dimensioned to receive photographs or the like. It will be understood, in this regard, that the application of the method of the instant invention to make pages having various different numbers of lines 22 thereon and having the lines 22 in various different spaced positions thereon is contemplated. The extruder assembly 20 preferably comprises a conventional adhesive extruder having a plurality of extruder nozzles 26 for extruding the adhesive streams 18 from the assembly 20. The adhesive which is extruded through the extruder assembly 20 preferably comprises a conventional polymeric hot-melt pressure-sensitive adhesive having a melting point of between 120° F. and 325° F. and having a viscosity of less than approximately 2500 cp. at 350° F. For example, an adhesive such as Hot Melt Adhesive No. X 593-335-01 manufactured by Findley Adhesives of Elm Grove, Wis., has been found to be effective. The adhesive is preferably heated to a temperature of approximately 325° F. to enable it to be effectively extruded with the extruder assembly 20, although the adhesive is preferably not heated to a temperature in excess of 350° F. since it has been found that excessive temperatures can cause distortion and warping in the sheet 14. Further, it is pointed out that it may be necessary to maintain the temperature of the adhesive at even lower ranges in order to prevent warping and distortion when plastic materials other than biaxis-oriented polypropylene and utilized for the sheet 14. In any event, it is preferable to cool the adhesive to a temperature of less than approximately 120° F. within one second after it has been applied to the sheet 14 in the lines 22 in order to prevent warping and distortion in the sheet 14. In this regard, it has been found that when the sheet 14 is passed through the work station 16 at a speed of in excess of approximately 100 ft./min., the air circulation around the sheet 14 causes the adhesive in the lines 22 to be cooled at a rate which is sufficient to prevent the sheet 14 from being distorted. However, when the sheet 14 is passed through the station 16 at slower rates, artificial cooling means, such as air conditining or cooled rollers, may be necessary to prevent warping and distortion in the sheet 14. In the next step of the method, a second sheet 28 which is preferably substantially identical to the first sheet 14 is overlayed on the sheet 14 in substantially aligned relation therewith so that the second sheet 28 contacts the adhesive in the lines 22, and thereafter, the sheets 14 and 28 are pressed together with a pair of rollers 30 to secure the sheets 14 and 28 together and to thereby form a continuous composite sheet generally indicated at 32. Thereafter, in the last step of the method, the composite sheet 32 is transversely cut at predetermined intervals to form the pages 10, and holes may be formed adjacent one of the cut edges in each of the pages 10 as needed for securing the pages 10 in a binder or the like.

For use of the pages 10 in an album, photographs or the like are inserted into the compartments which are defined by the open areas 24 between the lines of adhesive 22. Since both of the sheets 14 and 28 are transparent, the photographs can be assembled so that they face outwardly from either side of the page 10, and they can be effectively viewed through the transparent sheets 14 and 28. In this connection, since the sheets 14 and 28 are preferably made of biaxis-oriented polypropylene, they have high degrees of clarity so that photographs received therebetween can be effectively displayed on the page 10. Further, in the event that one of the seams defined by an adhesive line 22 becomes damaged, it can easily be repaired simply by applying pressure to the damaged seam from the opposite sides of the page 10 to resecure the sheets 14 and 28 together in the damaged area. Further, since biaxis-oriented polypropylene having a thickness of less than 2 mils. is substantially less expensive than the materials which have been required for the heretofore-available pages for photo albums, such as PVC having a thickness of 3 mils. or more, the page 10 can be manufactured at a substantially reduced cost.

Referring now to FIGS. 3 and 4, the page 12 is illustrated. Page 12 is identical to page 10 except that it has a background sheet 34 received in each of the open areas 24 between the lines 22. The page 12 is made in a process which is similar to that hereinabove described for manufacturing the page 10, except that the background sheets 34 are continuously overlayed on the sheet 14 between the lines of adhesive 22 before the sheet 28 is overlayed on the sheet 14. The background sheets 34 preferably comprise paper strips of an appropriate color, such as white, for providing backgrounds for photographs received in the open areas 24. Accordingly, when the page 12 is used in a photo album, a photograph can be inserted in outwardly facing relation one of the background sheets 34 and one of the sheets 14 or 28 to enable the photograph to be displayed on the page 12 in front of the adjacent background sheet 34. In this connection, it will be apparent that in most cases a plurality of photographs can be displayed in front of each side of each of the background sheets 34 so that several photographs can be displayed from each side of the page 12.

EXAMPLE

During a specific application of the method of the instant invention, two sheets of biaxis-oriented polypropylene having thicknesses of approximately 1.8 mils. each were continuously fed to a work station at a rate of approximately 120 ft./min. A polymeric hot-melt adhesive having a softening point of 150° F., a melting point of 174° F., a viscosity of 16,475 cps. at 250° F. and a viscosity of 2595 cps. at 325° F. was heated to a temperature of aproximately 325° F. and applied to a first one of the sheets in four narrow, spaced, longitudinally extending lines of adhesive. Specifically, the adhesive was Hot Melt Adhesive No. X593-335-01 manufactured by Findley Adhesives of Elmgrove, Wis.; and two of the ahesive lines were applied adjacent the opposite side edges of the first sheet, and the other two lines were applied in substantially equally spaced relations in the interior portions of the first sheet. It was found that since the sheets were moving at a relatively rapid rate of speed, there was enough air circulation to rapidly cool the adhesive to a temperature below its melting point so that it did not warp or distort the first sheet to any significant extent. After the adhesive was applied to the first sheet, three elongated paper background sheets having widths of approximately 3.5 in. were overlayed on the first sheet in the open areas between the adhesive lines, and the second biaxis-oriented polypropylene sheet was overlayed in substantially aligned relation on the first sheet so that it contacted the lines of adhesive thereon. Thereafter, the two biaxis-oriented polypropylene sheets with the paper background strips therebetween were passed between a pair of rollers in order to secure them together with the lines of pressure-sensitive adhesive. Finally, the composite sheet thereby formed was cut into sections of approximately 12 ins. to form pages. It was found that the new pages could be manufactured at a substantially reduced cost as compared to the pages which had been made by the previously known methods, and specifically that the cost was approximately 40% of the cost of the pages which were previously available. It was also found that the new pages were highly effective, and that the biaxis-oriented polypropylene sheets thereof had high degrees of clarity. Further, it was found that the new pages were durable, and that they could easily be repaired in the event that any of the adhesive seams thereof became damaged.

Accordingly, it is seen that the instant invention provides an effective method of manufacturing pages for photo albums and the like. The pages 10 and 12 can be manufactured at substantially reduced costs and at high rates of speed. Further, the pages 10 and 12 made by the method of the instant invention are highly durable, and the sheets 14 and 28 from which they are constructed have high degrees of clarity. In addition, the adhesive seams in the pages 10 and 12 can be easily repaired in the event that they become damaged. Hence, for these reason, as well as the other reasons hereinabove set forth, it is seen that the method of the instant invention and the page thereby formed represent significant advancements in the art which have substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of making pages for photo albums and the like comprising:

(a) continuously advancing a first elongated continuous sheet of biaxis-oriented polypropylene to a work station;

(b) continuously extruding at least two spaced streams of a liquified hot melt pressure-sensitive adhesive onto said first sheet at said work station to form at least two narrow, spaced, longitudinally extending lines of said adhesive on said first sheet;

(c) rapidly cooling said adhesive to a temperature below the melting point thereof;

(d) thereafter continuously overlaying a continuously moving second elongated continuous sheet of biaxis-oriented polypropylene in substantially aligned relation on said first sheet so that it contacts said lines of said adhesive thereon;

(e) pressing said first and second sheets together to secure them together along said lines of pressure-sensitive adhesive and to thereby form a continuous composite sheet; and (f) transversely cutting said composite sheet at predetermined intervals to form said pages.

2. In the method of claim 1, said first and second sheets further characterized as having thicknesses of less than approximately 2 mils.

3. In the method of claim 1, said adhesive having a melting point of between 120° F. and 350° F.

4. In the method of claim 3, said adhesive having a viscosity of less than 2500 cp at 350° F.

5. In the method of claim 1, said adhesive having a melting point of greater than 120° F. and a viscosity of less than 2500 cp at 350° F., said adhesive being extruded at a temperature of approximately 325° F.

6. In the method of claim 5, said first and second sheets continuously moving at speeds of greater than 100 ft./min.

7. In the method of claim 12, said cooling step further characterized as cooling said adhesive to a temperature of less than 120° F. within less than 5 seconds from the time said adhesive contacts said first sheet.

8. In the method of claim 1, said pressing step further characterized as passing said first and second sheets between a pair of rollers.

9. A page formed by the method of claim 1.

10. A page for a photo album comprising a first sheet of biaxis-oriented polypropylene, at least two spaced, substantially parallel, narrow lines of a pressure-sensitive adhesive on said first sheet and a second sheet of biaxis-oriented polypropylene overlayed on said first sheet and adhesively secured thereto with said pressure sensitive adhesive.

11. In the page of claim 10, said first and second sheets having thicknesses of less than approximately 2 mils.

12. A method of making pages for photo albums and the like comprising:

(a) continuously advancing a first elongated continuous sheet of biaxis-oriented polypropylene having a thickness of less than approximately 2 mils. to a work station;

(b) continuously extruding at least two spaced streams of a liquified pressure-sensitive adhesive onto said first sheet at said work station to form at least two narrow, spaced, longitudinally extending lines of said adhesive on said first sheet;

(c) continuously overlaying a continuously moving second elongated continuous sheet of biaxis-oriented polypropylene having a thickness of less than approximately 2 mils. in substantially aligned relation on said first sheet so that it contacts said lines of said adhesive thereon;

(d) pressing said first and second sheets together to secure them together along said lines of pressure-sensitive adhesive and to thereby form a continuous composite sheet; and (e) transversely cutting said composite sheet at predetermined intervals to form said pages.

13. A page formed by the method of claim 12.

* * * * *